US005461364A

United States Patent [19]

Sanford, Jr.; Jack G. et al.

[11] Patent Number: 5,461,364

[45] Date of Patent: Oct. 24, 1995

[54] INTRUSION DETECTION DEVICE

[76] Inventors: Jack G. Sanford, Jr., 226 N. 1st St., Campbell, Calif. 95008; Jack G. Sanford, Sr., 301 California, Columbus, Kans. 66725

[21] Appl. No.: 233,241

[22] Filed: Apr. 26, 1994

[51] Int. Cl.[6] ..... G08B 13/02

[52] U.S. Cl. ..... 340/541; 256/11; 256/12; 340/666

[58] Field of Search ..... 340/541, 666; 256/11, 12

[56] References Cited

U.S. PATENT DOCUMENTS

| | | | |
|---|---|---|---|
| 3,237,105 | 2/1966 | Kalmus | 340/562 |
| 3,634,638 | 1/1972 | Even-Tov | 200/61.93 |
| 3,696,372 | 10/1972 | Garrett | 340/541 |
| 3,950,746 | 4/1976 | Davies | 340/521 |
| 4,064,499 | 12/1977 | Geiszler et al. | 340/564 |
| 4,081,177 | 3/1978 | Graff | 256/12 |
| 4,155,083 | 5/1979 | Slaats et al. | 340/666 |
| 4,365,239 | 12/1982 | Mongeon | 340/564 |
| 4,525,701 | 6/1985 | Leih | 340/541 |
| 4,533,906 | 8/1985 | Amir | 340/541 |
| 4,680,573 | 7/1987 | Ciordinik et al. | 340/541 |
| 4,683,356 | 7/1987 | Stoler | 200/61.93 |
| 4,829,286 | 5/1989 | Zvi | 340/541 |
| 4,920,331 | 4/1990 | Ver Loren van Themaat et al. | 340/541 |

OTHER PUBLICATIONS

*Vtw-300 Electronic Taut Wire Fence:Installatiopn and Maintenance Manual*; Vindicator; Aug. 9, 1989.

*Primary Examiner*—Glen Swann

*Attorney, Agent, or Firm*—Patrick T. Reilly; James J. Leary; Carol A. Duffield

[57] ABSTRACT

An intrusion detection device that can be used singly or in multiplicity to immediately and silently alert the user of attempts to climb over a security fencing system. The invention consists of a base element which attaches to the security fencing, and an alarming arm. The alarming arm is equipped with barrier material, such as concertina wire or barbed wire. The alarming arm is connected to the base element both at a pivot point and through a tensioning means. Attempts to climb over the barrier material result in additional loading of the alarming arm which rotates transversely about the pivot point, and against the force of the tensioning means. This rotational displacement of the alarming arm enables an electrical sensing device which then signals that an intrusion is in progress.

10 Claims, 6 Drawing Sheets

INTRUSION DETECTION DEVICE

FIELD OF THE INVENTION

The present invention relates to security fencing and security fence alarming devices.

BACKGROUND OF THE INVENTION

There are thousands of miles of security fencing installed throughout the world today. The most common security fence structure consists of multiple strands of barbed or woven wire strung horizontally and secured to a series of vertical posts. An extension arm is often rigidly attached to the top of each vertical post. Extension arms are normally inclined towards the threat side of the fence and away from the area to be secured, at 45 degrees upwards from the fence post. These extension arms are used to secure additional strands of barrier material. The additional barrier material is strung horizontally and attached to a series of such extension arms.

Extension arms must be rigid and durable to be effective. By securing additional barrier material to the top of the security fence, they can be used to extend the height of the security structure. This is meant to make the security fence more difficult to scale.

The majority of improper intrusions into a site protected by security fencing are accomplished by climbing over the barrier structure rather than by cutting through the security fabric. A principal reason for this is that security fences are seldom alarmed and can be relatively easily climbed over. In fact, the extension arms of the typical woven wire security fence are often viewed as key support means for climbing by an intruder, rather than as an impediment. And the additional barrier material attached to the extension arm can be made ineffective by simply throwing a rugged fabric, such as blankets or carpeting, over the top of it. By such methods, a thoughtful intruder can transform the extension arm from an impediment into an asset.

It has long been recognized in the art that the timely detection of an intrusion into an area protected by security fencing is of great value. The prior art directed towards this end can often be classified as being of either mechanical or electronics means.

A fence length of 100 meters has been widely accepted by the international security industry as a standard zone length. Much prior art has therefore focused upon the task of providing reliable intrusion detection along this entire standard length while employing the fewest feasible number of detectors. This criterion for development has resulted in several designs and inventions which utilize both electrical and mechanical methodologies.

Conventional intrusion detection systems which rely upon electronic sensing techniques are typically susceptible to false alarms, and also require significant maintenance activity. The fence fabric itself must be kept taut, and the electronic sensing components must be readjusted on a constant basis.

One approach in electronic detection of intrusion consists of monitoring the motion of the fence fabric. It is an assumption of this method that any attempt to climb over or cut through a security fence will result in significant, and detectable, motion of the security fence material. As it is anticipated that the vertical posts supporting the fence fabric will exhibit far less motion than the barrier material during an intrusion, the electronic detectors are typically designed to be mounted directly onto the security fence fabric.

U.S. Pat. No. 4,365,239 issued on Dec. 21, 1982 to Ronald W. Mongeon, describes a detection system of this kind. The Mongeon invention employs microphonic coaxial cable stretched longitudinally along a fence as the sensing element. Electrical noise is generated in proportion to movement of the security fabric. This noise characteristic is monitored and analyzed with the hope of distinguishing movement caused routinely by wind, rain and other innocuous sources, from movement caused by intrusion efforts. This type of system requires constant maintenance on both the fence fabric and the electronics monitoring system, as the tension exhibited by the security fence fabric changes over time. The actual result is the generation of a large number of false alarms.

This prior art detection system is not installed along the barrier material attached to the extension arms. The extension arms can still be used by an intruder as a support in climbing, and the barrier material of the extension arms can still be overcome through the employment of a carpet or a blanket. An intrusion by such means would be accomplished without detection, as long as the intruder does not grasp, kick or cause excessive motion of the security fence fabric which is directly attached to the vertical posts.

An alternate electronic method of intrusion detection can be seen on the separate inventions of Kalmus (U.S. Pat. No. 3,237,105, issued Feb. 22, 1966) and Geiszler and Mongeon (U.S. Pat. No. 4,064,499, issued Dec. 20, 1977). Both of these systems employ long electrical wires suspended from fence posts. These long wires are used to create a quasi-stationary electrical field. A receiver is employed to monitor the strength of this field. It is expected that the physical presence and movement of an intruder within the protected area will result in a measurable perturbation of the imposed electrical field.

In practice, systems of this type evidence high false alarm rates due, in part, to the sensitivity of the detection method. Slight movements of the fence fabric, and hence the long wires, significantly vary the state of the imposed electrical field. Systems of this type also require constant maintenance for the adjustment of the tension of the long wires.

A third intrusion detection method employing electronic means can been seen in an invention by Ciordinik et al. (U.S. Pat. No. 4,680,573, issued Jul. 14, 1987). This method requires the installation of a wire component along the length of the barrier material of a security fence. This wire component includes electrically or optically conductive lines. These lines are positioned so as to be broken when subjected to excessive stress. Such breakage of the conducting line would be detected by an electrical or optical sensing monitor.

It is the apparent hope of the inventors that the conductive wire will break during an intrusion and seldom by any other innocuous cause. This method requires the employment of very special material that must be replaced after each incidence of breakage regardless of cause.

Mechanical design approaches have also been used in intrusion detection systems. One common mechanical apparatus requires the installation of long segments of trip wires along the length of the fence. Each strand of trip wire is firmly anchored at both ends of a detection zone and a tension sensing device is positioned towards the center of the detection zone. It is expected that an intruder will deflect a trip wire and thus be detected by the tension sensing device.

The trip wires must be constantly maintained in a high tension state. As a consequence the vertical support posts of the fence fabric to which the ends of the trip wires are usually anchored must be extremely massive and sturdy. This requirement can significantly increase the cost of construction and maintenance of the entire fence structure. The extension arms of more massive posts provide even more support to an intruder in climbing over a fence.

This system is prone to false alarms from several sources. For one, the trip wires are made from ferrous materials so as to be indistinguishable from the barrier material of the fence. As ferrous matter has a high coefficient of thermal expansion and the trip wires are typically exposed to daily and seasonal temperature variations the tension evidenced by the trip wires will change without external cause. This change in tension can by itself cause a tension sensing device to generate an alarm signal.

Additional sources of false alarms would include wind rain and landings by birds.

This type of mechanical detection of intrusion is commonly known as Taut Wire Fencing and is covered by a number of U.S. Patents. U.S. Pat. No. 4,533,906 issued on Aug. 6, 1985 to Yoel Amir covers the construction of Taut Wire Fencing. Tension sensing detectors are described in U.S. Pat. No. 3,634,638 issued on Jun. 11, 1972 to Ori Even-Tov and in U.S. Pat. No. 4,683,356 issued on Jul. 28, 1987 to Aric Stoler. A fiber optic variation of a Taut Wire Fencing detector is disclosed in U.S. Pat. No. 4,829,286 issued to Dank Zvi on May 9, 1989.

Taut Wire Fencing is also cited in a patent issued to Slaats et al (U.S. Pat. No. 4,155,083 issued on May 15, 1979). This patent describes the use of a composite wire of electrical coaxial configuration as a kind of trip wire. It is desired that the coaxial wire will be twisted or broken by an intruder so as to alter the electrical parameters (e.g. resistance or capacitance) of the effected segment of wire. Slaats et al points out that cutting the coaxial wire will also signal an intrusion event. This feature is presented as a significant improvement over previous inventions.

In all known Taut Wire Fencing methods the force needed to produce an alarm signal increases substantially as the distance from the application of force to the detector increase. Taut Wire Fencing is therefore mostly used in 50 meter segments as systems of this methodology become unreliable when used at 100 meter increments.

SUMMARY OF THE INVENTION

The present invention provides a means to instantly detect an intrusion over a security fence structure. There is thus provided in accordance with a preferred embodiment of the present invention a base element and an alarming arm. The base element is meant to be attached to a security fence structure. The alarming arm holds and supports barrier material, such as wire, barbed wire, razor ribbon, razor ribbon concertina, barbed wire concertina, wire mesh or woven wire, and is connected to the base element at a pivot point and through a tensioning means. The pivot point connection allows the alarming arm to deflect rotationally with respect to the base element. The tension means constrains the degree of this deflection, so that the alarming arm position remains within a predetermined range when the alarming arm is supporting only the barrier material.

The base element is attached to a post, a wall, or the security fence fabric of a security fence system.

The sum of forces between the load on the alarming arm and the restraining force of the tensioning means determines the instantaneous position of the alarming arm. When this position exceeds the predetermined range due to increased loading of the alarming arm, an electronic sensor is activated. This activation constitutes the intrusion alarm state of the invention.

The electronic sensor may be one of the following: electrical switches, electronic switches, micro-switches, optical switches or similar components. A sensor state signal transmission means communicates the instantaneous condition of the electronic sensor. The sensor state signal transmission means may be one of the following: standard electrical signal wire, metallic wire, electrical signal wire or cabling, fiber optic wire, or the like.

The existence of a range of motion of the alarming arm in which the electronic sensor is not activated allows the present invention to be highly resistive to generating false alarms. Common and insignificant loading events on the barrier material, such as the weight of birds or the force of winds, will not result in the issuance of an alarm signal.

The present invention provides for an essentially rugged mechanism that issues an alarm when an additional load or force of sufficient magnitude is placed upon the alarming arm or the barrier material. The alarming arm is automatically returned to the non-alarm state when the excessive load or force is removed.

It is an object of the present invention to provide a simple, rugged and economical intrusion detection device that will mount on a wide variety of security fence structures, to include standard extension arms located on the top of security fences.

It is an object of the present invention to instantly detect an intrusion attempt into a secure area by the method of scaling or climbing over the top of a security fence.

It is an object of the present invention to detect intrusions with an apparatus that is not damaged by the intrusion, and that automatically returns to a non-alarming state when the cause of the alarming state has ceased.

It is an object of the present invention to provide an intrusion detection device that can be easily installed onto existing security fences and requires little or no maintenance.

It is an object of the present invention to provide an intrusion detection device that has a uniform sensitivity along the entire scope of installation.

It is an object of the present invention to provide an intrusion detection device that can be mounted on the top of swinging or sliding gates. This aspect of the present invention allows the alarming system to be effective around the entire perimeter of a secure area.

BRIEF DESCRIPTION OF THE DRAWINGS

The present invention will be understood and appreciated more fully from the following detailed description made in conjunction with these three drawings in which.

DESCRIPTION OF THE EXAMPLE EMBODIMENT

Figure 2:
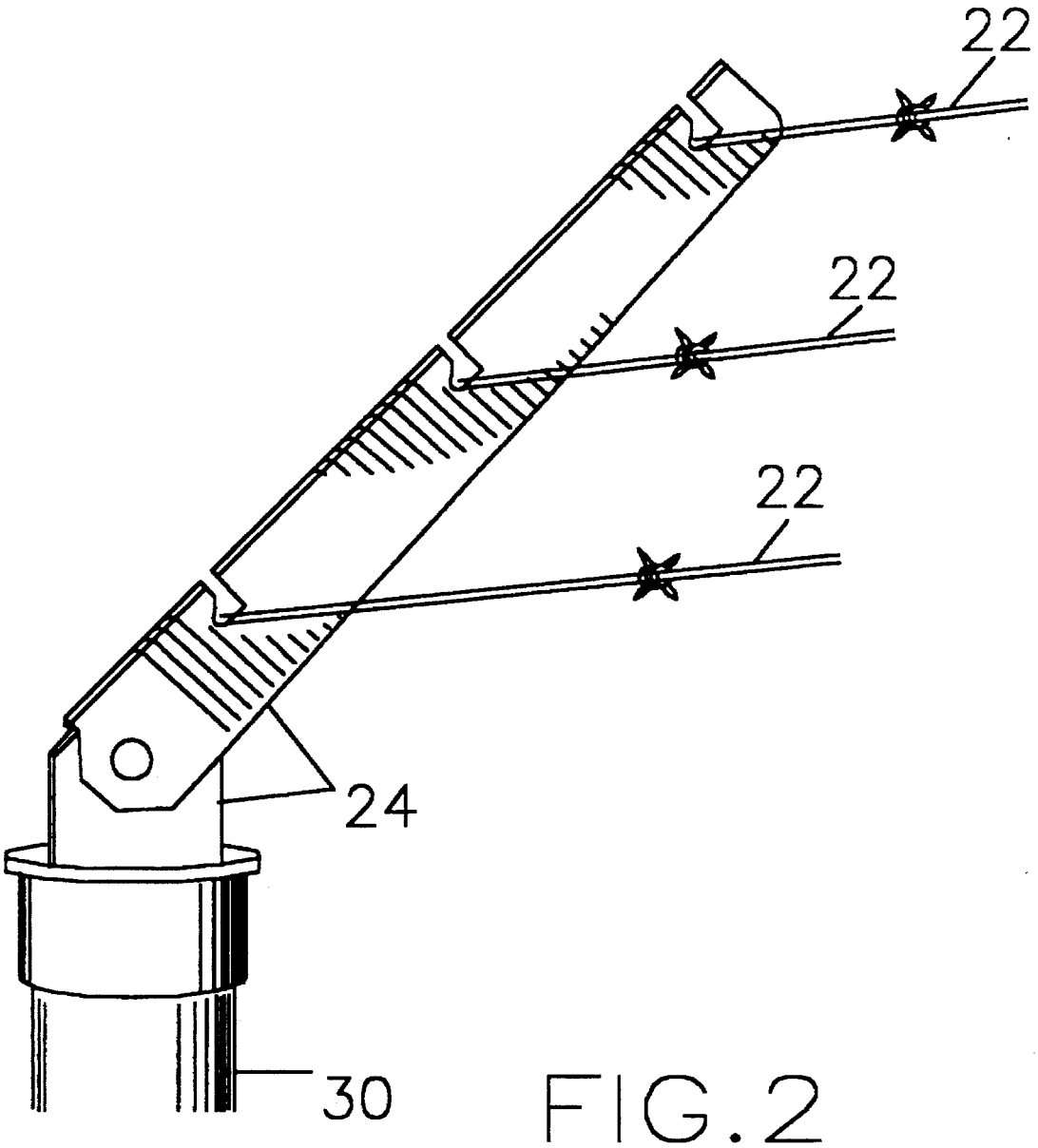
FIG. 2 is a pictorial illustration of a standard prior art non-alarming security fence extension arm mounted in place on a fence post of a security fence system.

Reference is first made to FIG. 2 where a prior art Extension Arm is illustrated. Extension Arm 104 is representative of non-alarming supporting arms widely used in prior art security fence designs. The attachment of several separate strands of Barbed Wire 102 to Extension Arm 104 constitutes a typical installation of barbed wire employment in a security fence design. Security Fence Post 110 is used as attachment and support means of Extension Arm 104 within a security fence arrangement.

Figure 1:
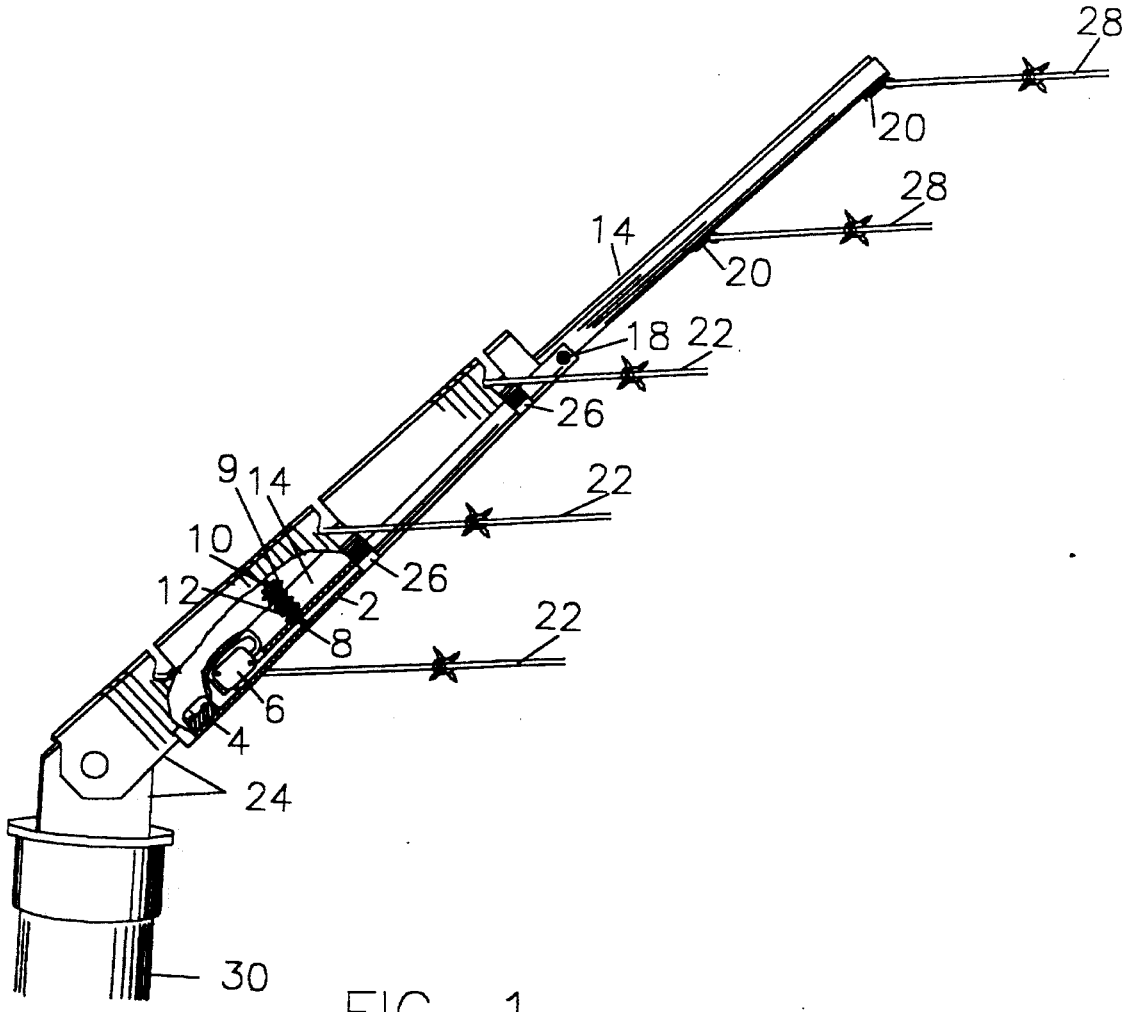
FIG. 1 is a cut-away side view illustration of an intrusion detection device constructed and operative in accordance with a preferred embodiment of the present invention and mounted to an extension arm.

Reference is now made to FIG. 1 where a preferred embodiment of the present invention is illustrated. The present invention is intended to be easily added to the existing components of conventional security fence designs. Base Element 2 is mounted onto Extension Arm 24 by means of Steel Strapping 26 at several points. Base Element 2 is connected to Alarming Arm 14 at Pivot Point 18 and by means of Tensioning Device 9. The movement of Alarming Arm 14 is thus limited to rotational motion about fixed Pivot Point 18, and is constrained in degree of movement by Tensioning Device 9.

Electrical Sensor 6 is attached to Alarming Arm 14. Electrical Sensor 6 comprises two separate and distinct sensing states, namely an alarming state and a non-alarming state. The instantaneous sensing state of Electrical Sensor 6 is determined by the relative position of Alarming Arm 14 with respect to Base Element 2. Alternatively, Electrical Sensor 6 may be affixed to Base Element 2.

Alarming Arm 14 extends the height of the security fence by extending further out from the security fence and by means of the addition of Alarming Barb Wire 28, as attached and secured by Strapping Material 20.

Tensioning Device 9 comprises Compression Spring 12, Tensioning Member 8, and Tension Adjustment Device 10. Tension Adjustment Device 10 allows the variable selection of tension which must be overcome in order for the Alarming Arm 14 to move from the non-alarming state to the alarming state. In the present embodiment Tensioning Member 8 comprises a threaded bolt and Tension Adjustment Device 10 comprises a threaded nut and washer. Tension Adjustment Device 10 compresses Compression Spring 12 in direct relationship to its set position on Tensioning Member 8.

This variable selectivity of Tensioning Device 9 allows the present invention to be optimally configured to minimize false alarms due to routine non-intrusion related loading of the Alarming Arm 14 and Alarming Barbed Wire 28. Routine non-intrusion related events would include precipitation wind gusts, and bird landings.

Tensioning Device 12 also insures that Alarming Arm 14 is returned to a non-alarming state after the source of a load or force of significant size to create an alarming condition has been removed. All transitions to and from alarming and non-alarming states occur automatically and without functional degradation of the apparatus of the present invention.

In an alternate preferred embodiment of the present invention, Electrical Sensor 6 has a variable setting regarding the transition point from the non-alarming state to the alarming state. This variable selection of the transition point further allows the present invention to be optimally configured to minimize false alarms. The transition point is defined as the locational position relative to which the Alarming Arm 14 is determined to be in the non-alarming state or an alarming state.

In another alternate preferred embodiment of the present invention Electrical Sensor 6 would not enter into the alarming state until after the Alarming Arm 14 had maintained its position within the alarming state for some set period of time. This accommodation to brief and momentary loading of the Alarming Arm 14 and Alarming Barbed Wire 28 would further reduce the incidence of false alarms without affecting the sensitivity of the present invention to actual intrusion events. The period of time required to activate the Electrical Sensor would be a fixed or a variable setting.

Electrical Sensor 6 is electrically connected to Electrical Terminal Block 4. The present invention may be connected to an alarm signal means at either Electrical Sensor 6 or Electrical Terminal Block 4. In an alternate preferred embodiment of the present invention Electrical Terminal Block 4 is unnecessary and may be deleted from the apparatus.

In another preferred embodiment of the present invention the alarm signal transmission means may comprise fiber optic or metallic signal wire or cabling, which would be wound along the length of the security fence fabric in its path from the Electrical Sensor 6 to a fence intrusion monitoring network. Should an intruder cut through the security fence fabric itself, the electrical transmission means would be severed. This interruption of the signal pathway between the Electrical Sensor 6 and the intrusion detection network would result in an alarm state condition. By this method the present invention may be further employed to both detect climbing over a security fence and cutting through a security fence.

Figure 3:
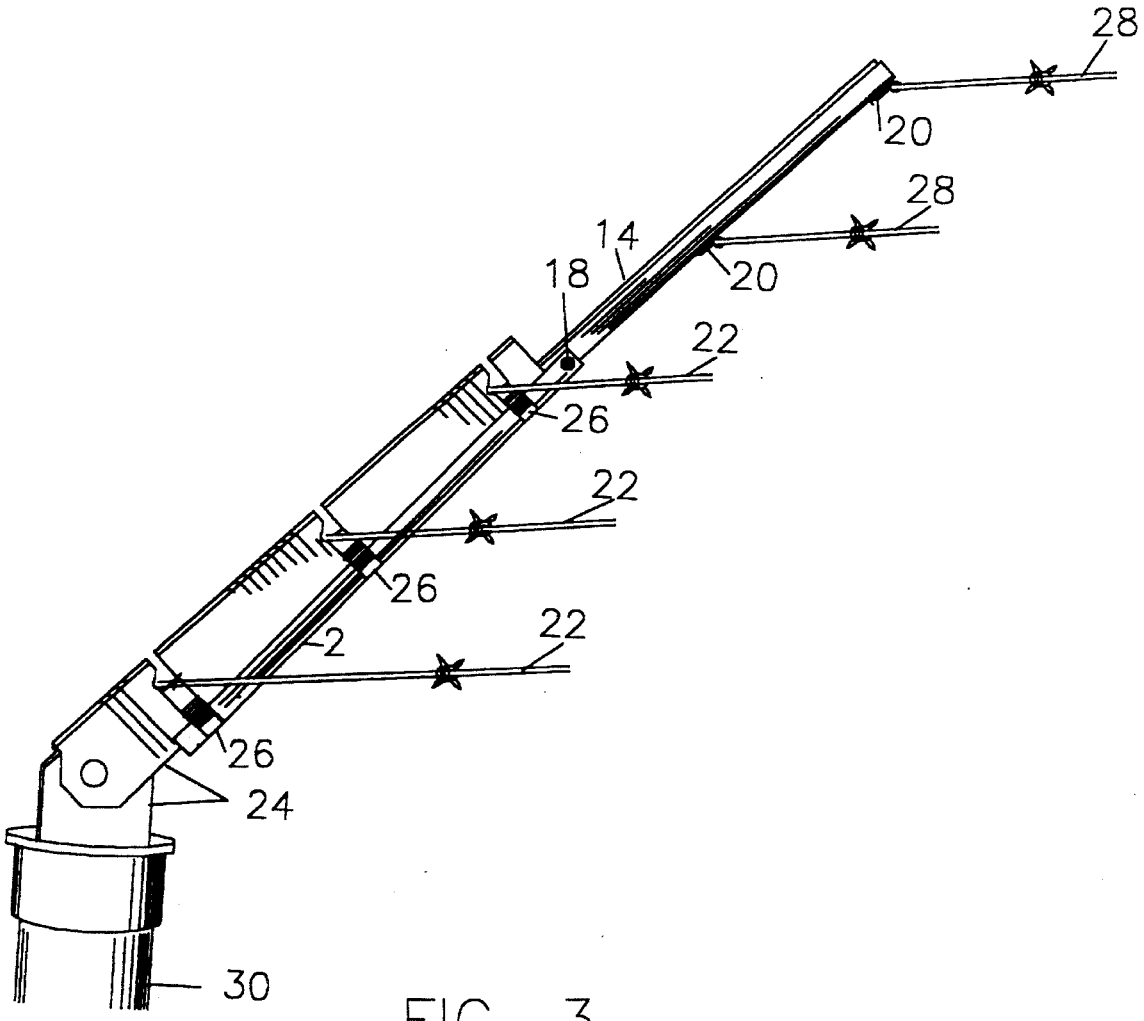
FIG. 3 is a simple side view illustration of a preferred embodiment of the present invention installed onto a standard extension arm.

Referring to FIG. 3, a preferred embodiment of the present invention is depicted (in simple side view) as installed into an extension arm according to the design of FIG. 1.

Figure 4:
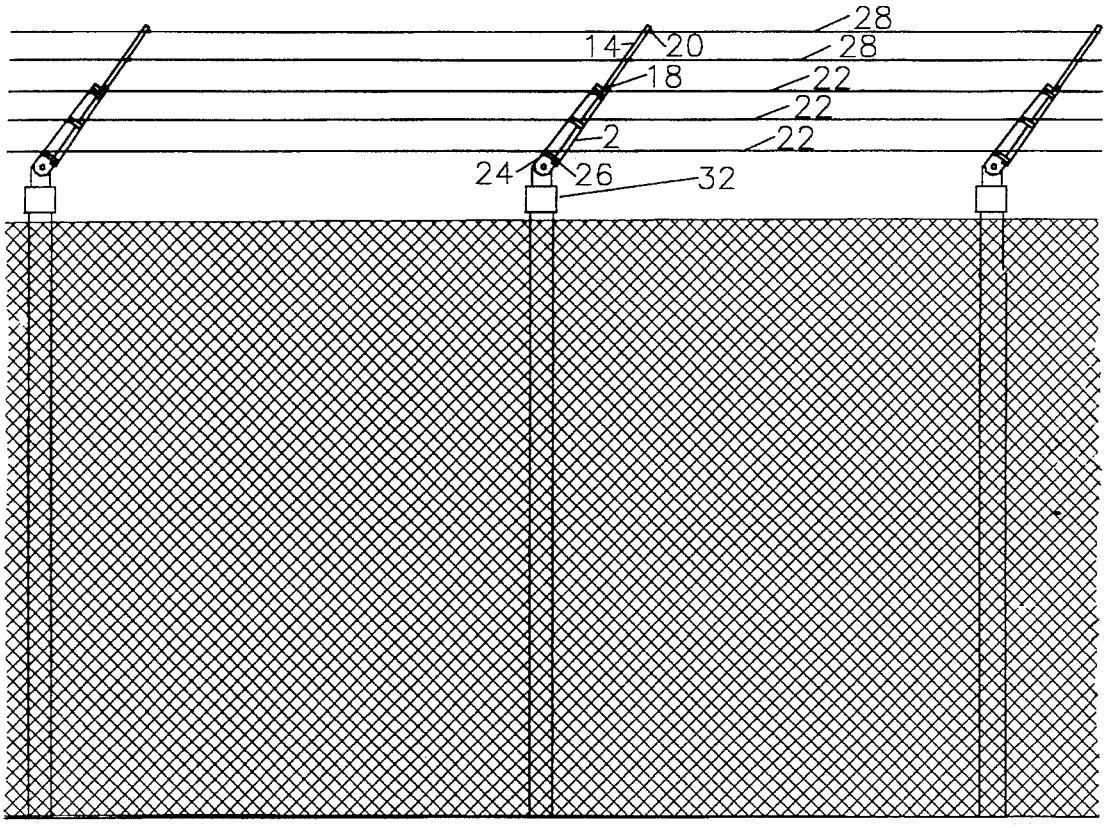
FIG. 4 illustrates a preferred embodiment of the present invention installed on posts.

Referring to FIG. 4, a preferred embodiment of the present invention is shown to be installed in multiplicity upon fence posts 32.

Figure 5:
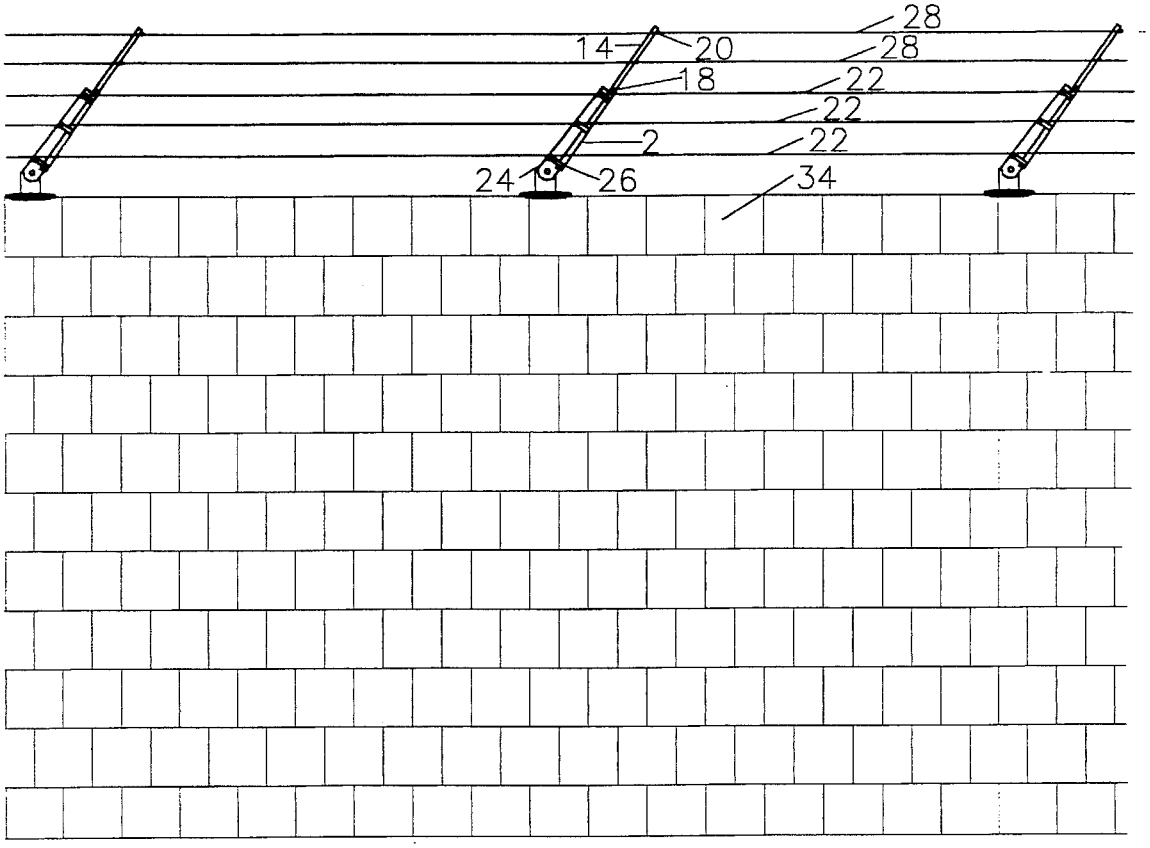
FIG. 5 illustrates a preferred embodiment of the present invention installed on a wall.

Referring to FIG. 5, a preferred embodiment of the present invention is shown to be installed in multiplicity onto a wall 34.

Figure 6:
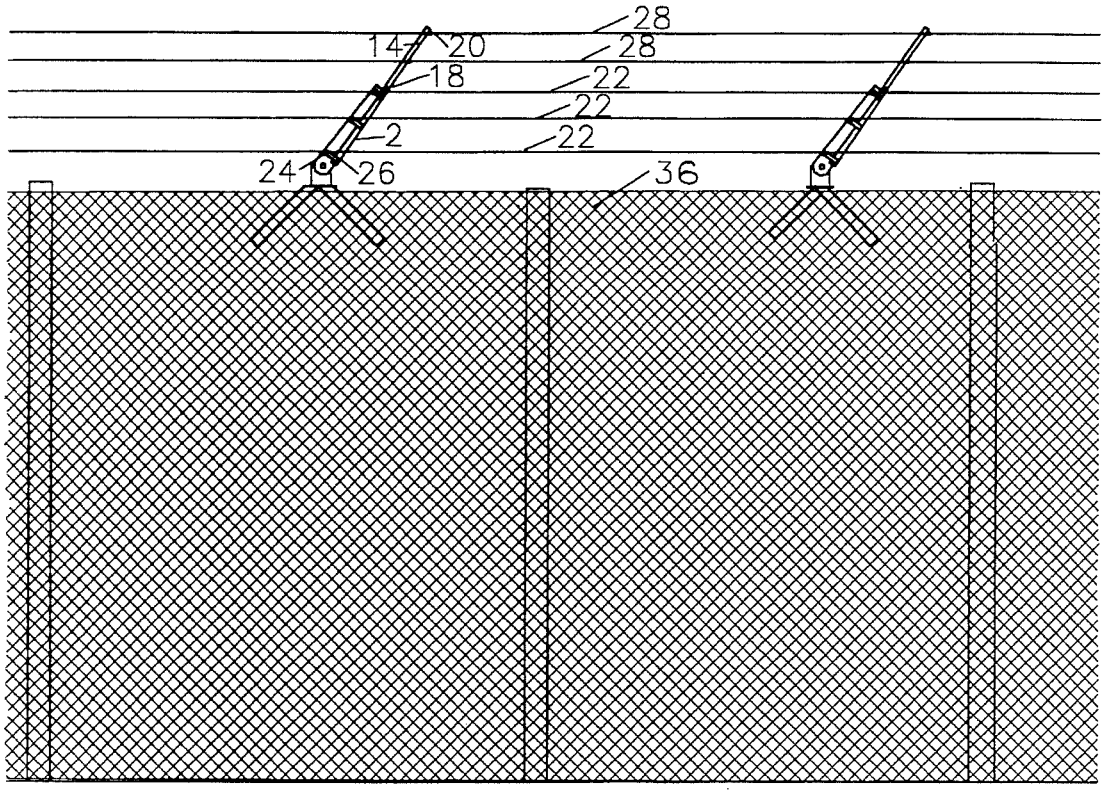
FIG. 6 illustrates a preferred embodiment of the present invention installed on security fence fabric.

Referring to FIG. 6, a preferred embodiment of the present invention is shown to be installed in multiplicity onto a security fence fabric 36.

What is claimed is:

1. An intrusion detection alarming device comprising:

a base element comprising a first end and a second end;

an alarming arm comprising an inner end, an outer end and a pivot point;

said alarming arm being pivotally attached to said base element at said pivot point;

a tension means comprising a base end and an arm end, said base end attached to said base element and said arm end attached to said alarming arm inner end;

a barrier material selected from the group consisting of wire, barbed wire, razor ribbon, razor ribbon concertina, barbed wire concertina, wire mesh and woven wire, said barrier material attached to and supported by said alarming arm outer end;

an electronic sensor means for detecting relative rotational deflection of said alarming arm with respect to said base element about said pivot point;

said sensing means having a first state and a second state, said first state occurring when said alarming arm is supporting said barrier material and said tension means is restraining the rotational deflection of said alarming arm about said pivot point and said electronic sensor is not detecting rotational deflection of said alarming arm, and said second state occurring when said alarming arm is supporting said barrier material and said tension means is extended due to the addition of force or weight applied to said barrier material or said alarming arm by an intruder and said alarming arm is rotationally deflecting about said pivot point and said electronic sensor is detecting the rotational deflection of said alarming arm;

a sensor state signal transmission means extending from said electronic sensor means; and a base connection means connecting said base element to a physical structure.

2. The device of claim 1 wherein said base connection means connects said base element first portion to an extension arm.

3. The device of claim 1 wherein said base connection means connects said base element to a post.

4. The device of claim 1 wherein said base connection means connects said base element to a wall.

5. The device of claim 1 wherein said base connection means connects said base element to security fence fabric.

6. The device of claim 1 wherein said electronic sensor means is a sensor selected from the group consisting of electrical switches, electronic switches, micro-switches and optical switches.

7. The device of claim 1 wherein said sensor state signal transmission means extending from said electronic sensor is a transmission means selected from a group consisting of metallic wire, electrical signal cabling and fiber optic wire.

8. In combination:

a barrier structure;

a multiplicity of intrusion detection devices, each of said devices comprising:

a base element comprising a first end and a second end;

an alarming arm comprising an inner end, an outer end and a pivot point;

said alarming arm being pivotally attached to said base element at said pivot point;

a tension means comprising a base end and an arm end, said base end attached to said base element and said arm end attached to said alarming arm inner end;

a barrier material selected from the group consisting of wire, barbed wire, razor ribbon, razor ribbon concertina, barbed wire concertina, wire mesh and woven wire, said barrier material attached to and supported by said alarming arm outer end;

an electronic sensor means for detecting relative rotational deflection of said alarming arm with respect to said base element about said pivot point;

said sensing means having a first state and a second state, said first state occurring when said alarming arm is supporting said barrier material and said tension means is restraining the rotational deflection of said alarming arm about said pivot point and said electronic sensor is not detecting rotational deflection of said alarming arm, and said second state occurring when said alarming arm is supporting said barrier material and said tension means is extended due to the addition of force or weight applied to said barrier material or said alarming arm by an intruder and said alarming arm is rotationally deflecting about said pivot point and said electronic sensor is detecting the rotational deflection of said alarming arm;

a sensor state signal transmission means extending from said electronic sensor means; and a base connection means connecting said base element to said barrier structure.

9. The combination of claim 8 wherein said electronic sensor means is a sensor selected from the group consisting of electrical switches, electronic switches, micro-switches and optical switches.

10. The combination of claim 8 wherein said sensor state signal transmission means extending from said electronic sensor is a transmission means selected from a group consisting of metallic wire, electrical signal cabling and fiber optic wire.

* * * * *